United States Patent [19]

Aerts et al.

[11] Patent Number: 4,462,681

[45] Date of Patent: Jul. 31, 1984

[54] APPARATUS FOR PRODUCING DUPLEX COPIES FROM DUPLEX ORIGINALS

[75] Inventors: Wilhelmus J. Aerts, Venlo; Gerhardus E. R. ter Horst, Grubbenvorst; Johannus L. J. M. Linssen, Baarlo, all of Netherlands

[73] Assignee: Océ-Nederland B.V., Venlo, Netherlands

[21] Appl. No.: 396,817

[22] Filed: Jul. 9, 1982

[30] Foreign Application Priority Data

Jul. 14, 1981 [NL] Netherlands ..... 8103336

[51] Int. Cl.[3] ..... G03G 15/00

[52] U.S. Cl. ..... 355/14 SH; 355/24; 271/3.1; 271/4

[58] Field of Search ..... 355/3 SH, 14 SH, 77, 355/23, 24, 50, 51; 271/3.1, 4, 288, 287, 289, 290, 173, 64

[56] References Cited

U.S. PATENT DOCUMENTS 4,212,457 7/1980 Guenther ..... 271/288
4,218,128 8/1980 Satomi et al. ..... 355/14 SH
4,229,101 10/1980 Hamlin et al. ..... 355/77

FOREIGN PATENT DOCUMENTS 1544045 5/1977 United Kingdom .

*Primary Examiner*—A. C. Prescott
*Attorney, Agent, or Firm*—Albert C. Johnston

[57] ABSTRACT

The copying apparatus comprises a document feeder having transport paths for simplex and duplex originals, and at least two copy transport paths for feeding finished copies from the image transfer means to a collection station. One copy transport path is operable to deliver a duplex copy fed therethrough to the collection station with the first printed side facing downwards, and the other copy transport path is operable to deliver a duplex copy to the collection station with the last printed side facing downwards. The copying apparatus further comprises selection means for selecting the desired type of copies, a detector in the original transport path for determining whether an original fed therethrough is simplex or duplex and control means for regulating the transport of copy sheets dependent on the type of originals detected by the detector and the type of copies selected with the selection means.

4 Claims, 3 Drawing Figures

APPARATUS FOR PRODUCING DUPLEX COPIES FROM DUPLEX ORIGINALS

The present invention relates to a copying apparatus suitable for producing duplex copies (copies printed on both sides) from duplex originals (originals provided with information on both sides).

A known apparatus for making duplex copies from duplex originals is described in British Patent Specification No. 1,544,045. As disclosed in that specification, that apparatus includes an original transport means with original transport paths including at least one feed path along which a duplex original is fed to an exposure station, a return path along which the duplex original is inverted and fed once again to the exposure station, and at least one discharge path along which the duplex original is transported from the exposure station to a storage station from which it can be fed once again to the exposure station; means for recording the information present on the original onto a recording medium; transfer means for transferring the information from the recording medium onto a sheet of receiving material; means for inverting the sheet of receiving material and feeding it once again to the transfer means to form a duplex copy; and means for discharging a duplex copy to a collector tray.

A disadvantage of that apparatus is that it provides an original transport means having a large number of branching transport paths, some of which include directionally-reversible transport means. This type of apparatus is complex and introduces an increased danger of breakdown during transportation of originals to and from the exposure station.

Another disadvantage with that known copying apparatus is that simplex (printed on one side) originals that are to be copied must be introduced into the holder of the original transport means in a manner different from that for duplex originals. Duplex originals must be inserted with the first side facing upwards, while simplex originals must be inserted in precisely the opposite manner with the first side facing downwards. As a result, it is easy for the copying machine operator to make mistakes.

Also known for the production of simplex or duplex copies, is the apparatus described in U.S. Pat. No. 4,218,128. That apparatus employs a recirculating document feeder provided with a detector for determining the type of original. That apparatus as disclosed, however, does not provide two distinct transport paths for feeding duplex copies from the image transfer means to the copy receiving tray. Further, the patent does not disclose selection means for programming the apparatus to produce a desired type of copy, or control means responsive to the detector and the selection means for regulating the transport of copy sheets required to make copies of the type selected. Therefore, the apparatus does not permit the degree of variation of copy control which is desired.

It is an object of the present invention to remedy these disadvantages. This and other objects are achieved according to the invention which provides a copying apparatus of the type known in that it includes an original transport means with original transport paths including at least one feed path along which a duplex original is fed to an exposure station, a return path along which the duplex original is inverted and fed once again to the exposure station, and at least one discharge path along which the duplex original is transported from the exposure station to a storage station from which it can be fed once again to the exposure station; means for recording the information present on the original onto a recording medium; transfer means for transferring the information from the recording medium onto a sheet of receiving material; means for inverting the sheet of receiving material and feeding it once again to the transfer means to form a duplex copy; and means for discharging a duplex copy to a collector tray. According to the present invention, however, the original transport paths are operable to invert a duplex original an odd number of times during each transport along said paths; and the means for discharging a duplex copy to the collector tray comprises two transport paths, one of which is operable to deposit a duplex copy into the collector tray with the side first printed facing downwards, and the other is operable to deposit a duplex copy in the collector tray with the side last printed facing downwards. Additionally, the apparatus of the invention includes control means for controlling the transportation of duplex copies, the duplex copies produced from the same duplex original being discharged alternately via the one or the other transport path.

According to a preferred embodiment of the invention, the original transport paths are operable to invert a duplex original therein a single time.

The transportation of duplex originals is considerably simplified according to the invention, and the danger of faults occuring during such transportation is reduced accordingly. The provision of different discharge paths for the duplex copies ensures that the copies are always deposited in the collector tray in logical sequence. The invention further ensures that duplex and simplex originals can be inserted in the same manner in the original transport means, thereby largely eliminating errors in this regard due to oversights on the part of the operator.

These and other advantages of the present invention will be apparent from the following description and the accompanying drawings, wherein.

Figure 1:
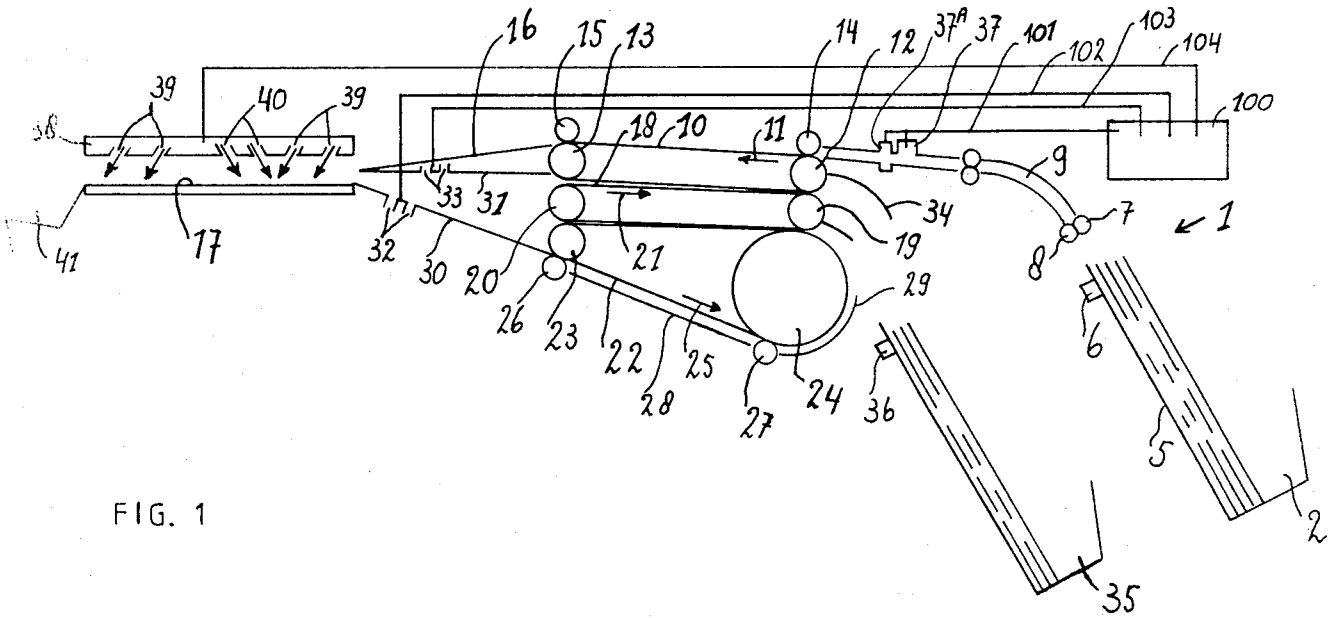
FIG. 1 is a schematic representation of a portion of a copying apparatus according to the invention that is provided with an original transport means.
Figure 2:
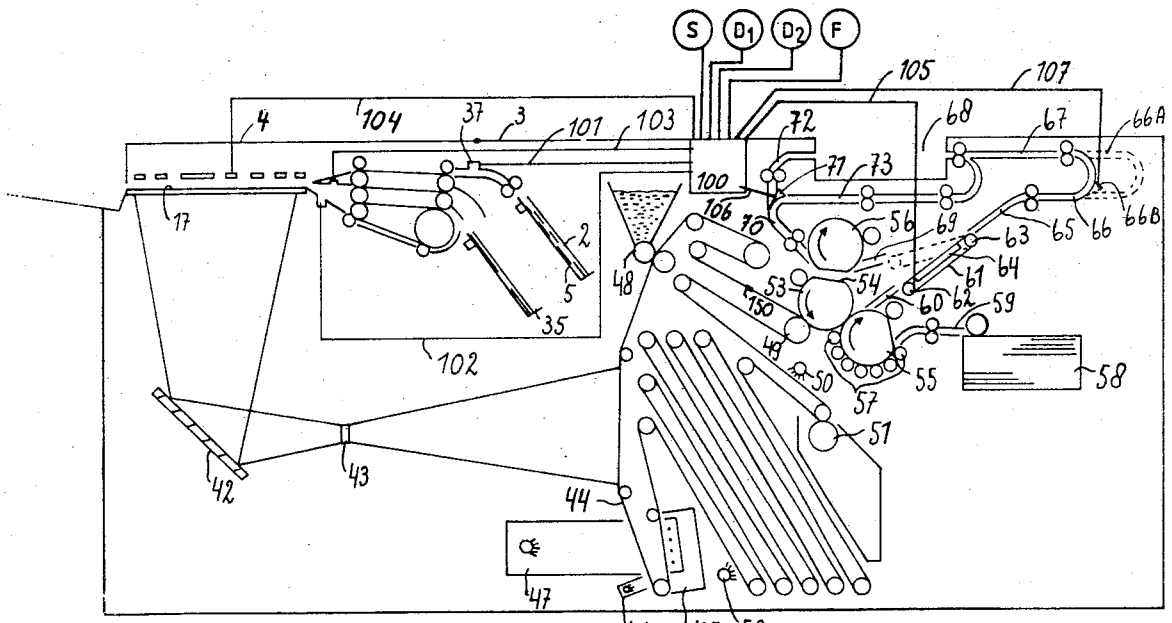
FIG. 2 is a schematic sectional view of an electrophotographic copying apparatus that is provided with an original transport means according to FIG. 1; and, FIG. 3 is a schematic representation of an alternate embodiment of image transferring means and copy transport paths that can be employed in a copying apparatus according to the invention.

The original transport means 1 shown in FIG. 1 comprises a storage station 2 which is accessible via a hinged cover 3 in the top plate 4 of the copying apparatus (see FIG. 2). A sheet removal mechanism 6, which as such is already known, is located close to the free end of the supporting plate 5 for storage station 2. The feed path of the original transport means 1 comprises transport rollers or discs 7 and 8, a guide 9, a conveyor belt 10 which runs about the rollers 12 and 13 in the direction indicated by arrow 11, transport rollers or discs 14 and 15 which cooperate with the conveyor belt 10, and a guide 16 which terminates at the exposure station 17 of the copying apparatus.

The conveyor belt 10 also cooperates with a conveyor belt 18 which runs about the rollers 19 and 20 in the direction indicated by arrow 21 and which in turn cooperates with a conveyor belt 22 which runs about rollers 23 and 24 and which is driven in the direction indicated by arrow 25. Transport rollers or discs 26 and 27 cooperate with the conveyor belt 22. Guide plates 28 and 29 are arranged parallel to the lower portion of the conveyor belt 22 and at a short distance therefrom.

In front of the nip between the transport roller 26 and the conveyor belt 22 running about roller 23, and in front of the nip between the conveyor belts 10 and 18 running about rollers 13 and 20, guide plates 30 and 31, respectively, are provided. These guide plates have apertures 32 and 33, respectively, through which air can be blown with the aid of means not shown in the FIG. 1. The guide plates 30 and 31 terminate close to the exposure station 17 and leave a free aperture through which originals from the exposure station 17 can be discharged.

The transport of an original from the exposure station 17 can take place via a path formed by guide plate 30, conveyor belt 22 as well as the transport rollers 26 and 27, guide plates 28 and 29, and conveyor belt 18 cooperating therewith. These means cooperate to invert the original and return it to the exposure station 17. Alternatively, the original can be deposited in a second storage station 35 by means of a path defined by guide plate 31, the cooperating conveyor belts 10 and 18, and a guideplate 34. With the aid of a sheet removal mechanism 36, the originals can be removed from storage station 35 and fed into the nip between the conveyor belts 18 and 22, to be fed once more onto the exposure station 17.

A detector 37 is installed in the guide 9 of the original feed path to scan the side of an original facing it as the original is fed through it. The detector determines if any information is present thereon. The detector 37 can comprise a scanning device of the type which is also employed in automatic exposure control systems for copying machines. Such scanning devices are known and are described, inter alia, in U.S. Pat. No. 4,124,295. The presence of information can for example be established by performing a contrast measurement, or by measuring the optical density with respect to a preset reference.

Detection means whose action depends on contrast measurement or measurement of optical density, are not suitable for use with transparent originals, which are always simplex originals. Transparent originals would be regarded by such detection means as duplex originals. In order to be able to correctly characterize transparent originals as well, the guide 9 can—apart from the previously-mentioned detection means 37—also include known detection means 37A which establish the transparency of the fed original. The detection means 37A can for example comprise a light source at one side of the guide 9 and a photocell opposite it on the other side. When the measured transparency exceeds a predetermined value, the original will always be regarded as simplex.

Above the exposure station 17, there is a chamber 38 which can move vertically between two limiting positions. In one position, the chamber is very close to but above the exposure station, leaving an aperture through which originals can be fed and discharged. In the second position, chamber 38 presses against the exposure station and serves as a pressure element for originals to be copied. The chamber 38 is provided with apertures 39 and 40 through which air can be blown, by means which are not shown, in the direction denoted by the arrows. Viewed from the original transport means 1 there is also a collector tray 41 located after the exposure station 17, which tray serves to collect the processed originals.

FIG. 2 schematically represents an electrophotographic copying apparatus provided with an original transport means according to FIG. 1. This apparatus is of the type employed as an office copying machine. An original fed onto the exposure station 17 is illuminated by flash lamps, which are not shown, the information from this original being projected via a mirror 42 and a lens 43 onto a photoconductive belt 44, which belt moves at a constant speed past the various processing stations. Before the photoconductive belt 44 passes through the projection plane it is electrostatically charged by means of a charging device 45. Charged sections of the belt located outside the image surface are dissipated by exposure devices 46 and 47.

After passing through the projection plane, the photoconductive belt 44 passes a developing device 48 where the electrostatic image formed on the belt is developed with the aid, for example, of developing powder, and then via a plurality of guide rollers, which are not numbered in FIG. 2, about a combined pressure/drive roller 49 into the image transfer station. The belt then proceeds via a guide roller and past a lamp 50 to a cleaning station 51 where any residual developing powder on the belt is removed. Finally, the belt proceeds via a plurality of guide rollers past a lamp 52 which neutralizes any electrostatic charge which may still be present on the belt and then again past the charging device 45 where it is again electrostatically charged so that a subsequent electrophotographic image can be formed thereon.

In the image transfer station, the developed image is transferred from the belt 44 to roller 53, which is positioned above the photoconductive belt 44 and the pressure roller 49. The roller 53 has a recessed flat portion 54 in which a clamping mechanism of the type known from the rubber blanket cylinders of offset printing machines is provided to hold a soft resilient external covering, such as silicone rubber, under tension about the cylindrical peripheral section of roller 53. Roller 53 cooperates with two rollers 55 and 56 which have the same diameter as roller 53 and which are similarly provided with recessed flat portions, and in the same way as roller 53 are provided with a carrier having a soft resilient external covering. Rollers 53, 55 and 56 are driven by common drive means, not shown in FIG. 2, so that they rotate in the direction indicated by the arrows. The flat portion 54 of roller 53 runs in synchronism with the flat portions of rollers 55 and 56.

Clamps are provided close to the trailing edges of the flat portions of rollers 55 and 56, for clamping the edge of a fed sheet of receiving material. These clamps, known to the art, are not shown in FIG. 2. Rollers 57 are arranged about a portion of the rotational path of roller 55. These rollers, like roller 53, are heated by means which are not shown. Each of the rollers 57 consists of a metal tube, the outer periphery of which is covered with heat-resistant, resilient material such as silicone rubber.

An unprinted sheet of receiving material can be fed from a stack 58 via guide 59 with the aid of the transport means arranged therein, not numbered in FIG. 2, to roller 55, and its leading edge is introduced into the clamp of this roller. The developed image is transferred onto the receiving material in the nip between the rollers 53 and 55. After the nip, there is an entrance to a guide 60. Guide 60 terminates at an endless conveyor belt 61 which runs about rollers 62 and 63 and on which the sheet of receiving is held firmly in place by means of a suction box 64. The transport direction of the conveyor belt 61 is reversible. After the conveyor belt 61, there is an entrance to the guide 65. Via this guide and the joining guides 66 and 67, a finished simplex copy can be delivered into a collector tray 68.

For the preparation of duplex copies, the roller 62 can be moved from the position shown in FIG. 2, using means which are not shown, into the position indicated by dotted lines, with the conveyor belt 61 occupying the position indicated by dotted lines. By bringing roller 62 into the dotted-line position after a single-sided printed sheet of receiving material has been fed onto conveyor belt 61, and then reversing the transport direction of the conveyor belt 61, the receiving material is delivered via a guide 69 to roller 56, and its leading edge is introduced into the clamp of this roller. In the nip between rollers 53 and 56 the second side of the sheet is provided with an image, after which the duplex-copy is introduced into a guide 70. At a switch 71 the guide 70 splits into a guide 72 which terminates in the collector tray 68, and a guide 73 which terminates in the guide 67 leading to collector tray 68. The switch 71 can occupy either of two positions, in which either guide 72 or guide 73 is accessible.

The control unit 100 functions as central control unit for the original transport means 1 and the copying apparatus. In the memory of the control unit, which may comprise a microcomputer, programs are stored for executing the various copying tasks. By way of various control lines, not shown in FIG. 2, control signals are supplied to the control unit and are issued by the control unit to the various copying functions.

An input line 101 is connected to the detector in the original feed path which discriminates between simplex and duplex originals and generates a corresponding first control signal which is then fed to the control unit 100. Output lines 102, 103 and 104 carry control signals for controlling the air supply to the apertures 32, 33 and 39, 40, respectively, in the plates 30, 31 and 38, respectively. Output control lines 105, 106 and 107 carry control signals for controlling the transport of the receiving material through the image transfer station to the collector station 68, depending on the type of original which is presented for copying and the type of copy which is required from the original.

Because the copying apparatus itself determines the type of originals presented for copying, the operator must specify only the type of copies desired. To enable the selection of the desired type of copy, selector buttons S, $D_1$, $D_2$ and F are provided on a control panel, by means of which the operator can inform the control unit 100 of the type of copies desired from a set of originals presented for copying.

If simplex copies are required, selector button S is operated.

Selector button $D_1$ specifies that duplex originals must be printed as duplex copies and consecutive simplex originals must be copied in the form of duplex copies as far as possible. For example, when selection button $D_1$ is operated for a four-sheet document, of which the first three sheets are simplex and the fourth sheet is duplex, the following types of copies will be produced: one duplex copy with sheets 1 and 2 on it, one simplex copy of sheet 3 and a duplex copy of sheet 4.

Selector button $D_2$ specifies that the copies must be duplex to the extent possible. The four-sheet document mentioned above is now printed as follows: one duplex copy with sheets 1 and 2 on it, one duplex copy with sheet 3 and the front side of sheet 4 on it, and a simplex copy of the rear side of sheet 4.

Operation of selector button F specifies that simplex originals must be printed as simplex copies and duplex originals as duplex copies.

The operation of apparatus according to the invention will now be described with reference to three exemplary apparatus configurations. The first configuration is that shown in FIGS. 1 and 2. The second will be with reference to FIG. 3. The third will be with reference to an apparatus of the type disclosed in U.S. Pat. No. 4,229,101.

I. EMBODIMENT OF FIGS. 1 AND 2

A. Copying Task S—Preparing Simplex Copies From Simplex And/Or Duplex Originals A multipage document is placed in storage station 2 in logical sequence with sheet 1 facing the bottom plate 5, and selector button S is operated. The lowest sheet (sheet 1) of the stack in storage station 2 is removed by the sheet removal mechanism 6 and fed via the rollers 7 and 8, guide 9 and conveyor belt 10 to the exposure station 17. In the guide 9 the side of the original which faces away from the exposure station 17 is scanned by the detector 37 and the control unit 100 is informed, via the input line 101, that the original is, for example, simplex. If more than one copy from the document is required, this information is stored in a memory of the control unit.

The original is placed in copying position at exposure station 17 by means of a flow of air which is blown through the apertures 39 in chamber 38. After the original has been positioned, the air supply to chamber 38 is terminated and chamber 38 moves downward in order to press the original against exposure station 17. The original is now illuminated, forming a charge pattern on the belt 44. The charge pattern is developed by the developing means 48, after which the powder image is transferred, by application of pressure in the nip between rollers 49 and 53, onto the heated roller 53. In the nip between rollers 53 and 55 the heat-softened powder image is transferred onto a sheet of receiving material fed from stack 58 into the clamp of roller 55. The simplex-copy is fed via guide 60, conveyor belt 61, and guides 65, 66 and 67, to the collector tray 68.

After the original has been illuminated, chamber 38 is raised, so that the original can be moved away from exposure station 17. If no further copy need to be made, air is blown through apertures 39, so that the original is deposited in the collector tray 41. If a subsequent copy has to be made, air is blown through apertures 40 in chamber 38 and apertures 32 in guide plate 30, to feed the original via guide plate 31 between the cooperating conveyor belts 10 and 18 for discharge to storage station 35.

Immediately after the copied original has been discharged from the exposure station 17, the next original is fed thereto. Prior to reaching station 17, this original is scanned by detector 37, and the information, e.g. that the original is duplex, is transmitted to the control unit 100 and stored in the memory. After the front side of this original has been illuminated, air is blown through the apertures 40 of chamber 38 and apertures 33 in plate 31 to convey the original over guide plate 30 and then along the path which inverts it and returns it to the exposure station 17 for copying the rear side. Thereafter, the original is either conveyed once more along the path in which it is inverted and deposited into collector tray 41, or discharged by conveyor belts 10 and 18 to the storage station 35.

For producing the second set of simplex copies from the document, the originals are fed from storage station 35 onto the exposure station 17. The operation for the second and each subsequent even set of copies of duplex-originals must be modified because each of the originals is stored at station 35 in inverted orientation. Referring to the same exemplary document copied above, the duplex-original is fed onto the exposure station 17, illuminated, inverted, once more brought onto the exposure station 17, and again illuminated. The simplex copy appertaining to the first illumination is then fed via guide 60 onto conveyor belt 61, after which the conveyor belt is brought into the position indicated by dotted lines. The direction of the belt is then reversed, and the copy is introduced into the clamp of roller 56 via guide 69. The conveyor belt 61 then returns to its initial position and conveys the copy subsequently arriving from the second illumination in guide 65. As soon as this last copy has reached or has almost reached collector tray 68, the copy which is held on roller 56 is conveyed via guides 70 and 72 to the collector tray 68.

After both sides have been copied, the duplex-original is returned into storage station 35 or is transferred directly from the exposure station 17 into the collector tray 41. If the duplex-original is returned to storage station 35 for producing a next set of copies, it is deposited in its original orientation in this storage station, so that upon producing the next (odd) set of copies, the simplex copies obtained can again be fed one after the other via the guides 65, 66 and 67 to the collector tray 68.

By augmenting guide 66 with a second guide 66A and by providing a switch 66B in front of the entrance to guide 66A, as indicated in FIG. 2 by dotted lines, the conveyance of simplex copies via the transfer means (53, 56) can be prevented. The switch 66B can occupy either of two positions, one in which the entrance to guide 66A is open and one in which the entrance to the remaining part of guide 66 is open. Upon producing each even set of copies from the document to be copied, a duplex original is fed from storage station 35 onto the exposure station 17, illuminated, inverted, fed once more to the exposure station, and once again illuminated. The simplex copy originating from the first illumination is then fed via guide 60, conveyor belt 61 and guides 66, 66A and 67 to collector tray 68, while the simplex copy originating from the second illumination is conveyed along the shorter path, i.e. via guide 66 instead of 66A, and thus overtakes the preceding simplex copy, so that the copies are received in collection tray 68 in the correct sequence.

B. Task $D_1$—Copying Simplex Originals As Far As Possible As Duplex Copies And Duplex Originals Always As Duplex Copies The document to be copied is placed in storage station 2 in the manner described above and on the control panel selector button $D_1$ is operated. For producing the first set of copies the originals are processed as described above with reference to the production of simplex copies. However, at the copy side the copying cycle must be modified. First, a single-sided printed sheet of receiving material is fed via guide 60 onto conveyor belt 61. If the image on this single-sided printed sheet originates from a duplex-original, the sheet is introduced into the clamp of roller 56 and the second image of the same duplex original is copied on the rear side of this sheet. The duplex copy is then fed via guides 70 and 72 to collector tray 68. If the image on the single-sided printed sheet originates from a simplex original, and if the next image to be copied also originates from a simplex original, then too the sheet is introduced into the clamp of roller 56. The duplex-copy is again delivered via the guides 70 and 72 to collector tray 68. If, however, the next image to be copied does not originate from a simplex original but from a duplex original, or if the image present on the single-sided printed sheet originates from the last simplex original from the document to be copied, then the single-sided printed sheet is delivered as a simplex copy via the guides 65, 66 and 67 to collector tray 68. The origin of the image present on a single-sided printed sheet, as well as of the next image to be copied, is determined by the control unit 100 from the information which is transmitted by detector 37 in guide 9.

Upon producing a second and subsequent set of copies from the document to be copied, simplex originals are fed from storage station 35 onto the exposure station 17, illuminated, and then delivered to storage station 35 or collector tray 41. Duplex originals are fed from storage station 35 onto the exposure station 17, illuminated, inverted, fed once more onto the exposure station 17, illuminated again, and then delivered to storage station 35 or collector tray 41. With each even set of copies produced, duplex copies which originate from a duplex original are delivered via guides 70, 73 and 67 to collector tray 68. On the other hand, duplex copies which originate from two consecutive simplex originals, are delivered via guides 70 and 72 to collector tray 68. With each odd set of copies, all duplex copies are conveyed via guides 70 and 72. All simplex copies are delivered via the guides 65, 66 and 67.

C. Copying Task $D_2$—Supplying Duplex Copies To The Extent Possible

The document to be copied is placed in storage station 2 in the manner described, and selection button $D_2$ is operated. During the production of the first set of copies, simplex and duplex originals are processed as described in connection with the production of simplex copies. The transportation of the copy sheets, however, must be modified. A single-sided printed copy sheet is fed via guide 60 onto conveyor belt 61, the conveyor belt is brought into the position indicated by the dotted lines, and its transport direction is reversed to feed the sheet into the clamp of roller 56. The duplex copy is then fed via the guides 70 and 72 to the collector tray 68. If the image on the single-sided printed copy sheet originates from the last page bearing information in the document to be copied, then this copy sheet is fed as a simplex copy via guides 65, 66 and 67 to collector tray 68.

During the production of the second and subsequent copy sets the copies are transported as described above. However, the movement of duplex originals must be modified. The duplex original is fed from the storage station 35 to the exposure station 17 with no exposure made, inverted, fed once more to the exposure station 17, and exposed. Then, the original is again inverted, fed once more to the exposure station, and again exposed. It is then fed back to the storage station 35 or discharged to the collector tray 41.

D. Copying Task F—Simplex Originals Copied As Simplex Copies And Duplex Originals As Duplex Copies With each set of copies which is produced, the originals are processed as described above in connection with the production of simplex copies. However, the operation with respect to copies must be modified. Simplex copies produced from simplex originals are always fed via the guides 60, 65, 66 and 67 to the collector tray 68. Duplex copies produced from duplex originals, on the other hand, are passed to collector tray 68, via the guides 70 and 72 for each odd set of copies, and via the guides 70, 73 and 67 for each even set of copies.

II. ALTERNATIVE EMBODIMENT OF FIG. 3

Figure 3:
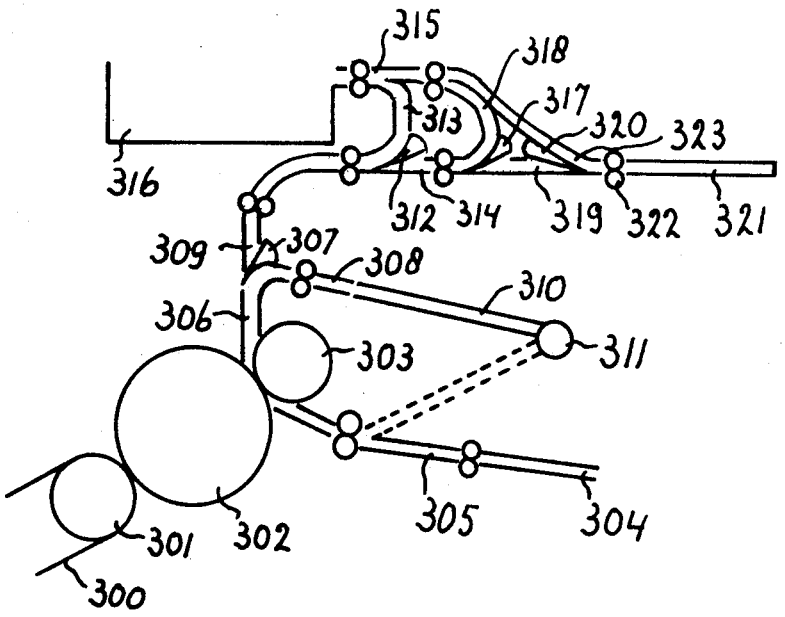

FIG. 3 illustrates another embodiment of the image transfer means and copy transport paths as can be employed in a copying apparatus according to the present invention.

The photoconductive belt 300 bearing a developed image, is fed over pressure roller 301 into the image transfer station. In the image transfer station the powder image is transferred to roller 302 which presses against the belt. The roller 302 is provided with a soft, resilient external covering not shown in FIG. 3, and is heated by heating means which are not shown. The roller 302 cooperates with a pressure roller 303 which is similarly provided with a soft, resilient external covering. A sheet of unprinted receiving material is fed via the guides 304 and 305 into the nip between rollers 302 and 303 wherein it picks up the image from roller 302. After passing through the nip between rollers 302 and 303, the sheet enters guide 306 which opens out at switch 307 into a guide 308 and a guide 309. Guide 308 opens out into a holder 310 which can pivot about a shaft 311 to the position shown by the dotted lines. This enables a sheet printed on one side which is fed into holder 310 to be fed again via guide 305 into the nip between rollers 302 and 303 for printing on the as yet unprinted side. At the switch 312 the guide 309 opens out into guides 313 and 314. Guide 313 opens out into guide 315 which terminates at a collector tray 316. At switch 317, guide 314 branches into a guide 318 which opens out into guide 315, and a guide 319 which at a freely-movable switch 320 leads into a guide 321. Guide 321 is provided with transport means 322, whose direction of transport can be reversed to enable feeding a copy to collector tray 316 via guides 323 and 315.

A. Copying Task S

In the embodiment of FIG. 3, simplex copies produced from simplex originals are always fed via guides 306,309,313 and 315 to the collector tray 316. And, odd sets of simplex copies from duplex originals are transported via the guides 306,309,313 and 315. However, during the production of each even set of copies, the first simplex copy obtained from a duplex original is always transported via the guides 306,309,314,318 and 315, and the second simplex copy obtained from the same duplex original is always transported via guides 306,309,313 and 315.

B. Copying Task $D_1$

With copying task $D_1$, duplex copies which are produced from two consecutive simplex originals are always transported via guides 306,309,314,319,321,323 and 315. Duplex copies obtained from duplex originals are transported via guides 306,309,314,319,321,323 and 315 during the production of each odd set of copies, and via guides 306,309,313 and 315 during the production of each even set of copies.

C. Copying Task $D_2$

With copying task $D_2$, the duplex copies are always transported via guides 306,309,314,319,321,323 and 315 to the collector tray 316.

D. Copying Task F

With copying task F, the simplex copies are always transported via guides 306,309,313 and 315 to the collector tray 316. Duplex copies are transported as described for copying task $D_1$.

III. ALTERNATIVE EMBODIMENT

The means 37, 37A for detecting the nature of an original offered for copying, and the means of selection for choosing the type of copy (S, $D_1$, $D_2$ and F), can also be employed on copying machines which are provided with an original transport means of the type in which first all the first sides of duplex originals are fed to the exposure station and then all the second sides, and which at the copy end are provided with an intermediate storage facility for the temporary storage of copy sheets printed on one side. Usually, the original transport means of these copying machines contain two discharge paths, one for returning simplex originals to the stack of originals in their original orientation after copying, and the other for returning duplex originals to the stack of originals in inverted orientation after the first side has been copied. With such means, the feed path and the return path for inverted duplex originals coincide. Such a copying machine is, for example, described in U.S. Pat. No. 4,229,101.

To be able to carry out the various copying tasks S, $D_1$, $D_2$ and F, the copying machine must once again be provided with two different copy transport paths for feeding finished copies from the transport means to the collector tray. The first copy transport path is designed in such a way that the copy is deposited in the collector tray with the side which has been printed first facing downward, while the second copy transport path is designed so that the copy is deposited with the side printed last facing downward.

A. Copying Task S

During the first passage, the originals are fed one after the other to the exposure station and are illuminated once. The copies of this first passage are deposited in the intermediate storage facility. The originals are returned to the stack, the control means ensuring automatically that simplex originals are conveyed by way of one path and duplex originals via the other path in which they are inverted and returned to the stack. During the second and up to and including the penultimate passage of the originals, the simplex originals are copied once and the offered side of duplex originals is copied twice. Each time an original in the second up to and including the penultimate passage is offered, the bottom copy from the intermediate storage facility is delivered to the collector tray. The copies which are made from simplex originals during the second up to and including the penultimate passage, are once again deposited into the intermediate storage facility. Of the two copies made from the same offered side of a duplex original, one copy is inserted at the proper place between the copies delivered to the collector tray, while the other copy is delivered to the intermediate storage facility. During the last passage of the originals, the simplex originals are no longer copied, but one copy is always conveyed from the intermediate storage facility to the collector tray. The offered side of a duplex original is copied once, and the copy thereof is inserted at the proper place between the copies discharged from the intermediate storage facility.

B. Copying Task $D_1$

During the first passage of the originals, the side of a duplex original which is fed to the exposure station is copied once and the copy is deposited into the intermediate storage facility. From the simplex originals fed to the reproduction station, only those originals are copied which have to be reproduced as the rear side of a copy to be produced, and the copies are similarly deposited into the intermediate storage facility.

In the second up to and including the penultimate passage of the originals all simplex originals are copied. Simplex originals which have to be reproduced as the front side of a copy to be reproduced, and which in the document to be copied are followed by a simplex original, are printed on the unprinted side of the relevant copy in the intermediate storage facility. The duplex copies thus obtained are fed via the second copy transport path to the collector tray. Simplex originals which have to be reproduced as the front side of a copy to be produced, but which are followed by a duplex original, are reproduced on an unprinted copy sheet and this copy is transported via the first transport path to the collector tray. Simplex originals which have to be reproduced as the rear side of a copy to be produced are again reproduced on an unprinted copy sheet and this copy is deposited in the intermediate storage facility.

The offered side of duplex originals is copied twice during the second up to and including the penultimate passage, one image being reproduced on the unprinted side of the relevant copy in the intermediate storage facility, and the other image being reproduced on an unprinted copy sheet. The duplex copies thus obtained are fed to the collector tray via the first copy transport path for each even passage of the originals, and via the second copy transport path for each odd passage of the originals. The simplex copies obtained are deposited into the intermediate storage facility.

During the last passage of the originals, the only originals which are copied are those which must be reproduced as the front side of a copy, and these are reproduced in the manner described in connection with the second up to and including the penultimate passage of the originals. The duplex copies and possibly simplex copies are fed via the second copy transport path to the collector tray.

The offered side of duplex originals fed during the last passage of originals is copied once and is reproduced on the unprinted side of the relevant copy from the intermediate storage facility. The resulting duplex copies are fed via the first or the second copy transport path to the collector tray, dependent on whether the last passage of the originals is an even or an odd passage.

C. Copying Task $D_2$

During the first passage of the originals, the process takes place as described for the first passage with copying task $D_1$.

During the second up to and including the penultimate passage of the originals, once again all originals are copied. In each even passage of the originals during that copying, a simplex original which is to be reproduced as the front side of a copy and is followed by a duplex original, is copied twice. One image is reproduced on the relevant copy from the intermediate storage facility, and the duplex copy thus obtained is fed via the second copy transport path to the collector tray. The second image is reproduced on an unprinted copy sheet and the copy is deposited into the intermediate storage facility. Simplex originals which have to be reproduced as the front side of a copy to be produced and which are followed by a simplex original, are copied once and reproduced on the relevant copy from the intermediate storage facility, after which the duplex copy is discharged via the second transport path to the collector tray. Simplex originals which have to be reproduced as the rear side of a copy to be produced are copied once, and the copy is deposited into the intermediate storage facility. The offered side of duplex originals is copied twice. One image is reproduced on the relevant copy from the intermediate storage facility and the duplex copy is discharged via one of the two copy transport paths. The copy transport path which is taken depends on whether the image which has just been reproduced forms the front side of a copy or a rear side of a copy. The control unit derives this from the information which it has obtained from the detection means in the original transport paths concerning the nature of the originals to be copied.

During each odd passage of the originals, simplex originals which must be reproduced as the front side of a copy and are followed by a duplex original, are not copied. The remaining originals are copied as already described for an even passage.

During the last passage of the originals, the simplex originals which must be reproduced as the front side of a copy are copied once and the image is reproduced on the relevant copy from the intermediate storage facility, after which the copy is fed to the collector tray via the second copy transport path. However, if the last passage of the originals is an odd passage, then simplex originals which must be reproduced as the front side of a copy and are followed by a duplex original, are no longer copied because a copy thereof is already present in the intermediate storage facility. The offered side of duplex originals is copied yet again and the image is again reproduced on the relevant copy from the intermediate storage facility. The duplex copy is fed via the first or the second copy transport path to the collector tray, dependent on whether the last image reproduced thereon is a front side of a copy or a rear side of a copy.

If the total number of original sides to be copied is odd, then obviously the last copy is delivered as simplex copy. If the last image originates from a duplex original, then the simplex copy is fed from the intermediate storage facility via the first copy transport path to the collector tray after each even passage of originals. If the last image originates from a simplex original, then with each even passage of the originals the copy is formed on an unprinted copy sheet and is fed via the first copy transport path to the collector tray.

D. Copying Task F

During the first passage, simplex originals and the offered sides of duplex originals are copied once, and the copies are deposited in the intermediate storage facility. In the second up to and including the penultimate passage of the originals, simplex originals are copied once and the copies are deposited in the intermediate storage facility. One each occasion when a simplex original is copied, the copy of the same original which is already present in the intermediate storage facility is discharged via the first copy transport path to the collector tray. The offered sides of duplex originals are copied twice. One image is reproduced on an unprinted copy sheet, and the copy is deposited into the intermediate storage facility. The second image is reproduced on the unprinted side of the relevant copy from the intermediate storage facility, after which the duplex copy is discharged via the first or the second transport path to the collector tray depending on whether the last image reproduced is a copy front side or a copy rear side.

During the last passage of the originals, only the offered side of a duplex original is copied, and the image is reproduced on the unprinted side of the relevant copy from the intermediate storage facility. The duplex copy is once again discharged via the first or the second copy transport path to the collector tray. On each occasion when a simplex original is fed during the last passage of the originals, the copy of that original which is already present in the intermediate storage facility is discharged via the first transport path to the collector tray.

The above description is for the purpose of describing the invention to the person skilled in the art. The description is not meant to describe in detail each and every obvious modification and variation of the invention which will become apparent to the skilled worker upon reading the description. It is intended, however, to include all such modifications and variations within the scope of the invention which is defined by the following claims.

We claim:

1. A copying apparatus suitable for the production of duplex copies from duplex originals, comprising an original transport means with original transport paths including at least one feed path along which a duplex original is fed to an exposure station, a return path along which the duplex original is inverted and fed once again to the exposure station, and at least one discharge path along which the duplex original is transported from the exposure station to a storage station from which it can be fed once again to the exposure station; means for recording the information present on the original onto a recording medium; transfer means for transferring the information from the recording medium onto a sheet of receiving material; means for inverting the sheet of receiving material and feeding it once again to the transfer means to form a duplex copy; and means for discharging a duplex copy to a collector tray, wherein: the original transport paths are operable to invert a duplex original an odd number of times during each transport along said paths; said means for discharging a duplex copy to the collector tray comprises two transport paths, one of which is operable to deposit a duplex copy into said collector tray with the side first printed facing downwards, and the second is operable to deposit a duplex copy in said collector tray with the side last printed facing downwards; and control means are provided for controlling the transportation of duplex copies, the duplex copies produced from the same duplex original being discharged alternately via the one or the other transport path.

2. A copying apparatus according to claim 1, wherein the original transport paths are operable to invert a duplex original a single time.

3. A copying apparatus comprising an original transport means including separate transport paths for simplex and duplex originals; an exposure station along the original transport paths; means for recording the information present on an original fed to the exposure station onto a recording medium; transfer means for transferring the information from the recording medium onto a copy sheet; copy transport paths including one path along which a copy sheet after passing the transfer means is inverted and fed once again to the transfer means and a plurality of paths along which finished copies are deliverable to a collector tray; guide elements in the copy transport paths for guiding a copy sheet along one of the possible copy transport paths; and control means for controlling operation of the copying apparatus, the said control means comprising detection means along the original transport paths for discriminating between simplex and duplex originals and generating corresponding first control signals, wherein: selection means are provided for producing second control signals to program the control means to control the production of the desired type of copies from a set of originals presented for copying; and the control means includes means for generating third control signals as a function of said first and second signals to control the guide elements and thereby regulate the transport of the copy sheets.

4. A copying apparatus according to claim 3, one of said copy transport paths being operable to deposit a duplex copy into said collector tray with the side first printed facing downward, and a second of said copy transport paths being operable to deposit a duplex copy in said collector tray with the side last printed facing downward; said control means being operable to cause duplex copies produced from the same duplex original to be delivered alternately via said one copy transport path and said second copy transport path.

* * * * *